US005402038A

United States Patent [19]

Parham et al.

[11] Patent Number: 5,402,038

[45] Date of Patent: Mar. 28, 1995

[54] METHOD FOR REDUCING MOLYBDENUM OXIDATION IN LAMPS

[75] Inventors: Thomas G. Parham, Gates Mills, Ohio; Michael E. Hanson, Cheswick, Pa.

[73] Assignee: General Electric Company, Schenectady, N.Y.

[21] Appl. No.: 878,107

[22] Filed: May 4, 1992

[51] Int. Cl.[6] ..... H01J 17/18; H01J 61/36

[52] U.S. Cl. ..... 313/623; 313/331; 313/345

[58] Field of Search ..... 313/623, 331–332, 313/345, 355

[56] References Cited

U.S. PATENT DOCUMENTS 3,420,944 1/1969 Holcomb ..... 174/17.05
3,793,615 2/1974 Homonnay et al. ..... 339/144 R
4,015,165 3/1977 Hardies ..... 313/318
4,539,509 9/1985 Varshneya ..... 313/629
5,021,711 6/1991 Madden et al. ..... 313/623

FOREIGN PATENT DOCUMENTS 3134907 of 1982 Germany .

*Primary Examiner*—Sandra L. O'Shea
*Attorney, Agent, or Firm*—Stanley C. Corwin; Edward M. Corcoran

[57] ABSTRACT

Electric lamps having molybdenum metal parts exposed to an oxidizing environment can withstand exposure to higher operating temperature if the molybdenum metal parts are coated with silicon nitride ($Si_3N_4$). Tungsten-halogen lamps having molybdenum outer leads coated with silicon nitride have operated for over 1500 hours at about 450° C. without oxidation failure of the leads.

16 Claims, 1 Drawing Sheet

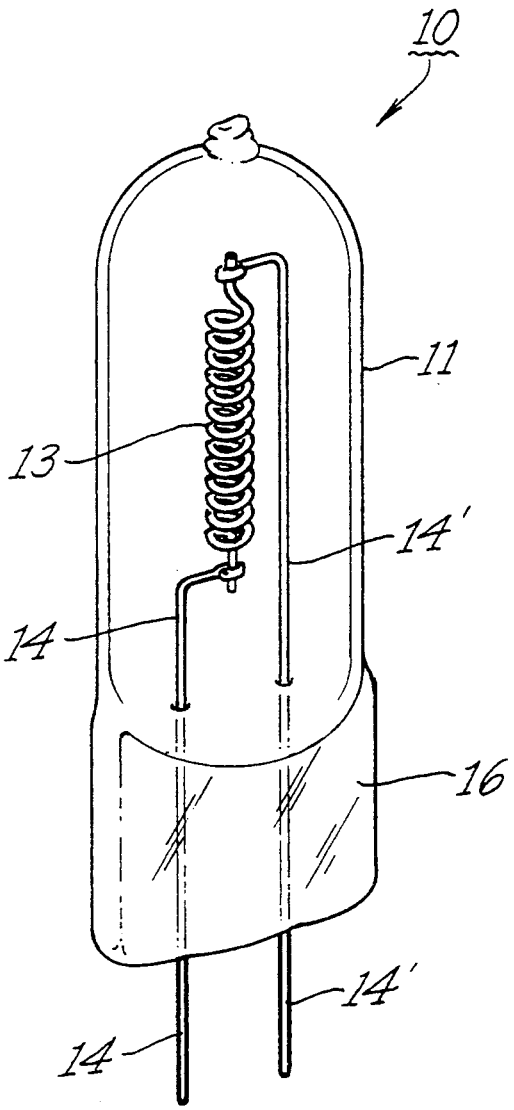
10
11
13
14'
14
16
14'
14

METHOD FOR REDUCING MOLYBDENUM OXIDATION IN LAMPS

BACKGROUND OF THE INVENTION

1. Field of the Invention

This invention relates to increasing the oxidation resistance of molybdenum, its preparation and its use in electric lamps. More particularly, this invention relates to molybdenum coated with silicon nitride and having increased oxidation resistance at temperatures above 350° C. and its use in electric lamps for increasing the life of molybdenum leads and also of hermetic seals between molybdenum and glass in lamps employing such seals.

2. Background of the Disclosure

The use of molybdenum for wire leads and other parts for electric lamps is old and well known to those skilled in the art. Molybdenum is used for such applications because of its ductility, conductivity, refractory properties and its thermal expansion properties which enable it to form hermetic seals with vitreous materials, such as glass and quartz. However, molybdenum is an oxidation sensitive material and rapidly oxidizes in an oxidizing environment (such as air) at temperatures of about 350° C. and higher. In the case of molybdenum used for outer lead wires and for foils for forming a hermetic seal with vitreous materials, such as a glass lamp envelope, this oxidation eventually results in an open electric circuit and lamp failure. In the case of molybdenum foil seals, the passageways or cracks formed during the sealing process permit oxygen to enter the foil area of the lamp seal as is disclosed in U.S. Pat. No. 4,918,353. Past efforts made to prevent the oxidation of molybdenum foils have included coating the outer half of the molybdenum foil with chromium (U.S. Pat. No. 3,420,944) and having the chromium coating wedge shaped (U.S. Pat. No. 3,793,615). Other proposed solutions to preventing oxidation of molybdenum outer leads consist of (i) covering the molybdenum with a coating or sleeve of nickel-plated brass (U.S. Pat. No. 4,015,165) and (ii) applying a sealing glass composition to the small space or passage between the outer leads and the lamp envelope (U.S. Pat. No. 4,539,509).

Notwithstanding the above, a problem still exists with respect to preventing the oxidation of molybdenum wire leads, lamp parts and foils exposed to an oxidizing environment at temperatures above about 350° C.

SUMMARY OF THE INVENTION

The present invention relates to increasing the oxidation resistance of molybdenum exposed to an oxidizing environment at temperatures above 350° C. and its use with electric lamps, wherein such oxidation resistance is obtained by coating the surface of the molybdenum with silicon nitride. This discovery has resulted in substantially increased life for lamps having molybdenum leads exposed to oxidizing environments at temperatures in excess of 350° C.

BRIEF DESCRIPTION OF THE DRAWINGS

The figure is a schematic illustration of a tungsten halogen lamp having silicon nitride coated molybdenum leads according to the present invention.

DETAILED DESCRIPTION

The silicon nitride coating may be applied to molybdenum wire, foil or other lamp parts, or to the completed lamp structure, by any of a number of different methods, the choice of which will be left to the practitioner. Such methods include chemical vapor deposition and electrochemical methods such as silicidation. The deposited coating should adhere to the molybdenum, be coherent and be at least 500 Å thick so as to be relatively impervious to oxygen at the temperatures at which the coated parts will be exposed to oxygen. The coating provides passive protection inasmuch as it acts as a barrier coating to prevent the oxidation of the molybdenum and not as a sacrificial coating. Such coatings may be applied to the molybdenum prior to sealing same in a vitreous lamp envelope, provided the temperature reached during sealing is below 2200° C. (or the coating will be destroyed). Thus, the coated molybdenum must not be exposed to temperatures as high as 2200° C. and probably not much higher than 1800° C.

Numerous methods for low pressure or atmospheric chemical vapor deposition (CVD) are known and are described, for example, in Vossen and Kern, eds., *Thin Film Processes,* pp. 298–299, Academic Press, Orlando (1978); Hess and Jensen, *Microelectronics Processing: Chemical Engineering Aspects,* ACS, Washington, D.C. (1989); Pulker, *Coatings on Glass,* Elsevier, Amsterdam (1984); and Bunshah, ed., *Deposition Technologies For Films And Coatings,* Noxes Pub., (1982).

Two different silicon nitride atmospheric CVD reaction pathways which have been found to be particularly useful in coating both molybdenum metal lamp parts and completely assembled lamps having molybdenum leads with a coating of silicon nitride according to the invention are:

$$3\ SiCl_4 + 4\ NH_3 \xrightarrow[>550°\ C.]{} Si_3N_4 + 12\ HCl \quad (1)$$

$$3\ SiH_2Cl_2 + 4\ NH_3 \xrightarrow[>550°\ C.]{} Si_3N_4 + 6\ HCl + 6\ H_2 \quad (2)$$

Reaction (2) is advantageous since reagent handling is more convenient in that $SiH_2Cl_2$ is a gas at 25° C. and atmospheric pressure. Therefore, it is possible to directly meter this reagent into a reactor with a flow meter. In reaction (1), $SiCl_4$ gas is delivered to a reactor by bubbling nitrogen carrier gas through liquid $SiCl_4$ at 25° C. In both reactions (1) and (2), it is preferred that the silicon reactant-containing vapor be delivered to the reactor separately from the ammonia to minimize gas phase reactions which can result in particle formation.

Reaction 1 has been used in a facile manner to coat molybdenum lamp parts and fully assembled lamps in the laboratory by putting both molybdenum parts and completely assembled lamps having molybdenum outer leads (and/or foil seals) in a furnace in an inert atmosphere and heating to a temperature of about 625° C. Once the 625° C. temperature was reached, separate streams of the two reactants ($SiCl_4$ and $NH_3$) each diluted with nitrogen, were permitted to flow into the hot furnace. A large excess (i.e., 2X) of ammonia was used to insure formation of stoichiometric $Si_3N_4$ for the reason set forth below. By way of example, a two inch internal diameter reactor surrounded by a muffle furnace operating at atmospheric pressure, with a flow of 5 cc/min. of $SiCl_4$, 50 cc/min. of $NH_3$ and 200 cc/min.

of nitrogen. The nitrogen was mixed with the $SiCl_4$ prior to entering the reactor.

Employing this process and these conditions enabled the deposition on the molybdenum and other parts of silicon nitride ($Si_3N_4$) films having thicknesses ranging between 800–6,000 Å. Laboratory results of the so-coated molybdenum parts indicated an optimum thickness of the $Si_3N_4$ coating of about 2,500 Å employing this method. The so-formed coatings are basically colorless, but have a slightly iridescent appearance like light interference films. Use of a large (i.e., 2X) excess of $NH_3$ is particularly preferred when the silicon nitride coating is applied to completed lamp assemblies, in order to achieve a coating of stoichiometric silicon nitride and to avoid the entrainment of unreacted elemental metal silicon (excess silicon) in the coating. Entrained silicon in the coating renders the silicon nitride coating conducting. The presence of such unreacted elemental silicon in the film was also found to absorb light if it was applied to the completed lamp assembly (which, in the case of a halogen-incandescent lamp, included the molybdenum outer leads and the vitreous lamp envelope surrounding the tungsten filament and halogen fill). By unreacted elemental silicon or excess silicon is meant silicon present in an amount above stoichiometry for the $Si_3N_4$ and generally at least 5% more than the stoichiometric amount in the $Si_3N_4$. The excess silicon can be present as silicon metal or a solution of Si in $Si_3N_4$.

Tungsten halogen incandescent lamps of the type generally depicted in FIG. 1 were employed for a number of tests in association with the present invention. Referring to FIG. 1, there is depicted a typical regenerative cycle tungsten halogen lamp 10 having a transparent glass envelope 11 formed from a high temperature alumina silicate glass. A tungsten filament 13 is connected to and supported within said glass envelope by two lead wires 14, 14' made of molybdenum which extend through the customary hermetic pinch seal 16. Glass envelope 11 also contains a halide fill comprising inert gas and at least one halogen as is known to those skilled in the art. A suitable high temperature glass from which the lamp envelope 11 may be made is disclosed in U.S. Pat. No. 4,737,685 assigned to the assignee of this invention.

Molybdenum wire leads coated with a 2500 Å thick stoichiometric silicon nitride ($Si_3N_4$) coating were tested for compatibility in high temperature glass pinch seals in lamps as described above and illustrated in FIG. 1 by forming a pinch seal over the silicon nitride molybdenum coated leads. The temperature employed in order to effect a hermetic pinch seal with the glass was approximately 1350° C. The coating on the molybdenum wires showed no visible cracking, flaking or other degradation after the pinch seal operation. Furthermore, no bubbles were observed in the glass seal area and the seals had good hermeticity as demonstrated by a helium leak test. Oxidation tests conducted in air for 15 hours at 550° C. on such pinch seals and lamps having pinch seals over the $Si_3N_4$ coated molybdenum wire according to the present invention showed that the films still provided good oxidation resistance even after the pinch sealing operation. The silicon nitride coated molybdenum wire leads exhibited little or no oxidation under these test conditions, whereas the molybdenum wire leads that were not coated with the silicon nitride film were almost totally oxidized to low density, fluffy, yellow molybdenum oxide. Similar tests made on lamps fabricated using uncoated molybdenum lead wires, but wherein the entire lamp (leads included) was coated with $Si_3N_4$ after the pinch seal had been made, produced results the same as for lamps fabricated using coated molybdenum lead wires. It should be noted that at a temperature of about 550° C. molybdenum oxide sublimes. Thus, 550° C. represents a temperature of rapid and catastrophic failure for unprotected molybdenum in an oxidizing environment.

Additional tests were made with the lamps described above wherein the lamp was fabricated using uncoated molybdenum leads, after which the completed lamp, including that portion of the molybdenum leads extending out from the pinch seal, was coated with silicon nitride (2500 Å). These lamps were cemented to an aluminized glass parabolic reflector having a lens cemented on the forward end. The cement was permeable to air so that the lamps were not hermetically sealed. These lamp-reflector-lens assemblies were energized. Those assemblies employing the silicon nitride coated lamp were still operating after 1500 hours, whereas similar assemblies wherein neither the lamps nor the molybdenum inleads were coated failed after only about 100 hours of operation due to oxidation and breaking of the molybdenum inleads. The approximate temperature of the seal area during operation of the tungsten-halogen lamps employed in these lamp assemblies was determined to be about 450° C.

The above is intended to be illustrative and not limiting with respect to the practice of the invention. Other lamp configurations and uses of molybdenum may be used as those skilled in the art will know. The invention may be used with lamps using molybdenum foil to achieve a hermetic seal. Further, the invention may also be used with molybdenum outer leads and foil seals in connection with lamps having fused quartz envelopes wherein the hermetic pinch seal or vacuum seal is achieved at about 2200° C. In this case the entire lamp assembly will be coated or, if desired, that portion of the lamp other than the seal region or regions may be masked prior to applying the silicon nitride coating. The choice is left to the practitioner.

What is claimed is:

1. An electric lamp comprising a vitreous envelope having at least one metal outer lead construction hermetically sealed in at least one end thereof wherein said outer lead construction comprises molybdenum hermetically sealed into said vitreous envelope and wherein said molybdenum is coated with silicon nitride.

2. The lamp of claim 1 wherein said silicon nitride coating is at least 500 Å thick.

3. The lamp of claim 2 wherein said coating contains less than 5% excess silicon.

4. The lamp of claim 3 wherein said vitreous envelope is a high temperature glass or fused quartz.

5. The lamp of claim 4 comprising a tungsten halogen incandescent lamp or an arc discharge lamp.

6. The lamp of claim 5 whose outer surface, including said molybdenum lead, is coated with said silicon nitride coating.

7. An electric lamp comprising a vitreous envelope having at least one molybdenum lead construction hermetically sealed in said envelope, wherein the outer portion of said lead is exposed to an oxidizing environment at temperatures of at least 350° C. during operation of said lamp and wherein said outer surface of said molybdenum lead is coated with silicon nitride.

8. The lamp of claim 7 wherein said coating is at least 500 Å thick.

9. The lamp of claim 8 wherein said coating is electrically nonconductive.

10. The lamp of claim 9 being a tungsten-halogen lamp.

11. The lamp of claim 16 wherein said vitreous envelope comprises a high temperature glass composition.

12. The lamp of claim 10 wherein said vitreous envelope is made of fused quartz.

13. The lamp of claim 12 the outer surface of which is coated with silicon nitride.

14. The lamp of claim 9 wherein said coating contains less than 5% excess silicon.

15. A method of coating a molybdenum lead for an electric lamp comprising exposing said lead to vaporized $SiCl_4$ and $NH_3$.

16. A method of coating a molybdenum lead for an electric lamp comprising exposing said lead to vaporized $SiH_2Cl_2$ and $NH_3$.

* * * * *